US005884591A

United States Patent [19]

Giese

[11] Patent Number: 5,884,591

[45] Date of Patent: Mar. 23, 1999

[54] DRIVE MECHANISM FOR PERIODICALLY MOVING AT LEAST ONE VALVE

[75] Inventor: Peter Giese, Herzogenaurach, Germany

[73] Assignee: INA Wälzlager Schaeffler OHG, Herzogenaurach, Germany

[21] Appl. No.: 58,689

[22] Filed: Apr. 10, 1998

[30] Foreign Application Priority Data

May 30, 1997 [DE] Germany ..... 197 22 632.9

[51] Int. Cl.[6] ..... F01L 9/04

[52] U.S. Cl. ..... 123/90.11; 251/129.01

[58] Field of Search ..... 123/90.11; 251/129.01, 251/129.04, 129.11

[56] References Cited

U.S. PATENT DOCUMENTS

| | | | |
|---|---|---|---|
| 4,641,812 | 2/1987 | Vanderlaan et al. | 251/129.11 |
| 4,911,404 | 3/1990 | Dorste et al. | 251/129.11 |
| 5,113,824 | 5/1992 | Haubner | 251/129.11 |
| 5,494,007 | 2/1996 | Schroeder et al. | 123/90.11 |
| 5,515,818 | 5/1996 | Born | 123/90.11 |
| 5,592,905 | 1/1997 | Born | 123/90.11 |
| 5,775,276 | 7/1998 | Yanai et al. | 123/90.11 |

FOREIGN PATENT DOCUMENTS

| | | |
|---|---|---|
| 40 35 376 A1 | 5/1991 | Germany . |
| 06288211 A | 10/1994 | Japan . |

*Primary Examiner*—Weilun Lo

*Attorney, Agent, or Firm*—Panitch Schwarze Jacobs & Nadel, P.C.

[57] ABSTRACT

An electromagnetic drive mechanism (1) for the periodic movement of at least one valve (2) for gas exchange of an internal combustion engine is provided. The valve (2) includes a disc-type rotor (9) located at an end (8) of its shaft (5). The rotor (9) is surrounded by a stator (12), a small gap (22) located between the rotor and the stator. The rotor (9) and stator (12) have ring windings (10, 13). When the stator (12) is supplies with electric voltage from a voltage converter **(13*a*) with a microprocessor (14), the rotor (9) with the valve (2) is moved axially by the magnetic field which forms. The drive mechanism (1) operates selectively as a synchronous motor, reluctance motor, or asynchronous motor, and is provided with mechanisms (21) for current regeneration so that after the electric drive mechanism (1) is turned off immediately before reaching an excursion limit of the valve (2), the electric power gained in this way can be stored intermediately and supplied for the next lifting travel to the drive mechanism (1)**.

13 Claims, 1 Drawing Sheet

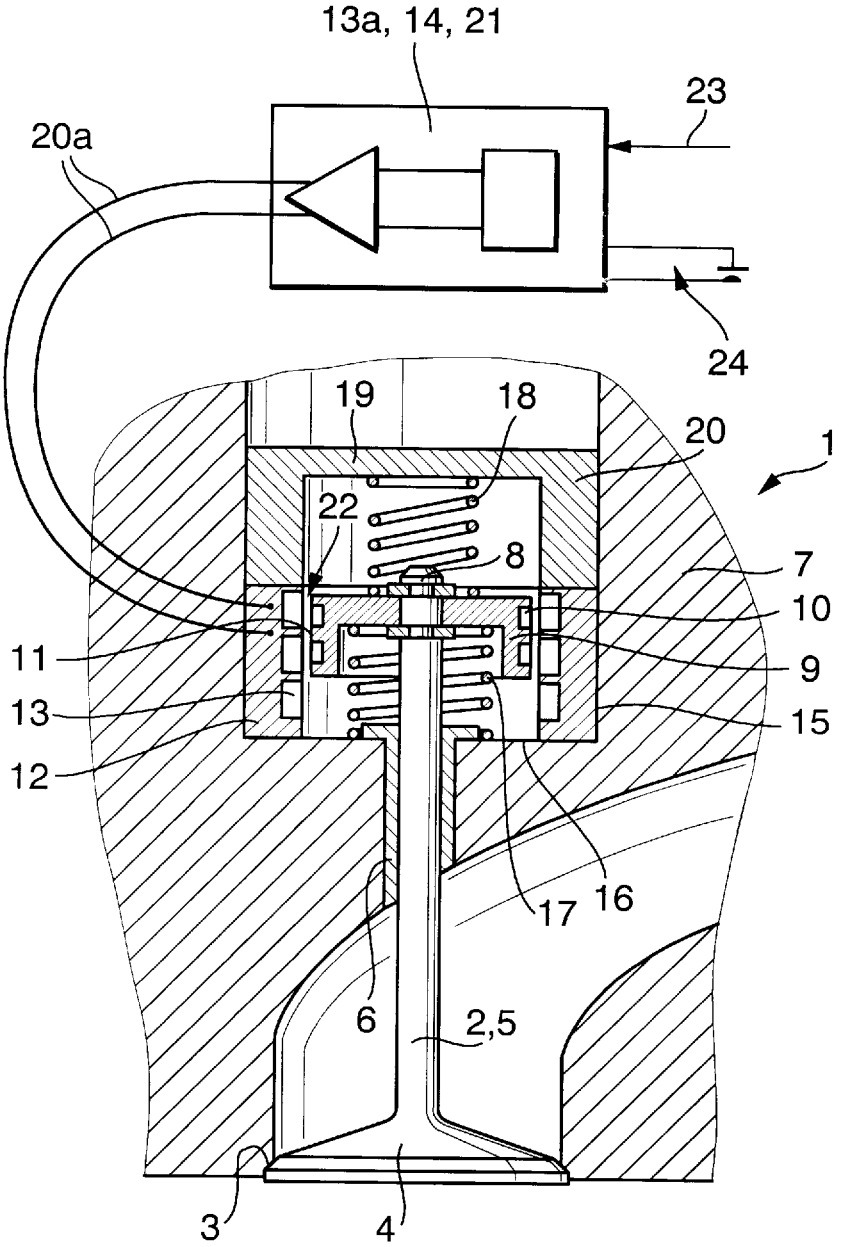
13a, 14, 21
23
20a
24
19
18
20
1
22
8
7
10
11
9
13
15
12
17
16
6
2,5
3
4

DRIVE MECHANISM FOR PERIODICALLY MOVING AT LEAST ONE VALVE

FIELD OF THE INVENTION

The invention involves a drive mechanism for periodically moving at least one valve for a gas or liquid exchange in the opening and closing direction.

BACKGROUND OF THE INVENTION

A similar drive mechanism is known in this technical field from the patent DE-OS 26 30 512, for example. The drive mechanism shown there functions as an electromagnetic valve drive mechanism for the gas exchange valves of an internal combustion engine. For drive mechanisms of this type, the customarily-used traditional cam drive mechanism, which has a camshaft and radial cams and is connected via a drive mechanism to the crankshaft, can be omitted. Generally, a system of this sort functions as a spring mass oscillator with its own resonance frequency. The lifting magnets, which are arranged at a distance from the excursion limits of the valve, cause an opening and closing of the valve by the switching on and off of electric power. It is disadvantageous in the system previously described that an extreme development of noise occurs due to the unavoidable mechanical stop in the region of the excursion limits. In addition, a variation of the valve lift itself is not possible, so that it is not possible to make smaller gas exchange cross sections than the maximum cross section at the valve. These smaller gas exchange cross sections, however, prove to be sensible in multi-valve technology, for example, such as four-valve technology, while the internal combustion engine is running at idle or under partial load. In this case, a higher angular momentum and thus an improved mixture formation and combustion is expected due to the reduced gas exchange cross section at the valve.

In addition, there is no suggestion to the specialist from the cited state of the art of how he can recover at least a portion of the electric power conducted into the system. Anyway, it can be determined in and of itself that the system previously known from the patent DE-OS 26 30 512 consumes a relatively large amount of power (approx. 3 kW) and is difficult to control due to its mechanics alone. Furthermore, because of its mean position sensitivity, the costly installation of a hydraulic play compensation component is recommended.

Furthermore, in the extreme case, not only can undesired noises be emitted by the hard end stops, but also the valve can expand in an undesirable way due to its jerky change in acceleration, or in the extreme case, its plate can even tear off.

Professionals have attempted, of course, to eliminate the disadvantage of the hard touch-down of the valve, for example, by hydraulic damping measures which are known to those skilled in the art and not explained in greater detail here. However, these measures have proven to be very costly and difficult to control in construction.

SUMMARY OF THE INVENTION

The object of the invention is to create a drive mechanism of the above-referenced type in which the cited disadvantages are eliminated, which operates electromagnetically, and in which using simple mechanisms, a soft stop of the impinged valve in the region of its excursion limits is obtained, which at the same time provides the possibility of a non-graduated adjustment of the lift travel.

This object is achieved according to the invention by providing a drive mechanism for periodic movement of at least one valve for a gas or liquid exchange in opening and closing directions. The mechanism includes a valve having a closing plate which rests on a seat in a closed position and a shaft, attached to the plate, which is located in a guide of a surrounding part such that the shaft can move axially. The shaft has a first end to which a disc-type rotor is attached which has at least one electrically conducting ring winding extending in a circumferential direction. The rotor includes an outer sleeve which is surrounded at least in a portion of a lift range by a ring-shaped stator which is spaced from the rotor. The stator has at least one electrically conducting, coil-type ring winding. A voltage converter with a microprocessor which provides electrical power to the ring winding of the stator is provided to impinge movement of the valve. The stator functions according to a principle of one of a synchronized motor, a reluctance motor and an asynchronous motor. Other features of the invention are defined in the dependent claims, for which separate protection is also sought. Furthermore, a process is provided for the operation of the drive mechanism according to the invention discussed herein. In the process, the stator is impinged with electrical voltage in a first step. In a subsequent step, immediately before the valve reaches an excursion limit position, a drive mechanism is switched to a generating operation to generate electrical energy, which is then stored in an intermediate D.C. circuit of a voltage converter.

By the drive mechanism of the present invention, which refers to a drive mechanism for the movement of a valve for gas exchange of an internal combustion engine, in a first embodiment of the invention, an electromagnetic valve operation constructed in a simple manner is created using electric linear drive mechanism. The expert is given, by the selection of the electromotive principle from one of a synchronized motor, a reluctance motor and an asynchronous motor, a simple theory of how to create a drive mechanism of this type.

After the ring windings of the stator have been charged by electric voltage, the rotor connected to the valve is instantaneously shifted in the direction towards one of the excursion limits of the valve because of the magnetic field which forms. For maximum excursions of the valve of, for example, 10 mm, valve oscillations up to 120 Hz can be achieved. Thus, for the range of the highest rotational speed of the internal combustion engine, for example, 7,000 rotations per minute and higher, operation can also be securely done without the so-called "valve flutter" occurring, as is known from traditional cam shafts.

Depending on the type of electric motor selected, the rotor is provided with or without ring windings (short-circuit windings), or with or without reluctance slots (reluctance motor). This rotor corresponds, in a transferred sense, to the rotor in electromotors, and is made, in an advantageous way, of transformer plate. The stator which surrounds it is manufactured from transformer plate which is low in eddy current losses, and has ring windings to the necessary extent. These ring windings are made of copper, for example.

The rotor is loaded in the closing direction of the valve by a compression spring in such a manner that the valve reaches its seat when the drive mechanism is switched off. Thus, the spring force of this recoil mechanism, where at this position another mechanical recoil mechanism or hydraulic recoil mechanism is conceivable, only amounts from one (1%) percent up to a maximum of 30% of the recoil force of the previously known valve springs. The previously known valve springs were designed, as is well known, for the range of the maximum rotational speed of the internal combustion engine, in order to also create a secure closing of the gas exchange valve after its mechanically generated lift. Thus, these valve springs were clearly oversized for the most often driven, average to lower rotational speed and loading range of the internal combustion engine. The spring mechanism proposed according to the present invention needs only to overcome the dead weight and internal friction of the valve when the drive mechanism is switched off, in order to guide the valve to its seat. Thus, according to the drive mechanism proposed here, only an extremely small quantity of energy is required to overcome this spring force.

It is also proposed to construct the drive mechanism as a so-called spring-mass-oscillator, whereby the rotor connected to the valve is effected by another spring mechanism which operates opposite to the direction of force of the first spring mechanism. The system could then function in resonance operation.

The pot described in a further embodiment of the invention functions as a simple bearing mechanism for the other compression spring. If necessary, this pot can have at least one passage in its bottom area; this passage, in connection with an air gap present between an outer sleeve of the rotor and the stator, prevents the formation of an unnecessary air cushion within the stator.

The stator is supplied according to the invention from a voltage converter having an intermediate circuit and mechanisms for current regeneration as well as a microprocessor control. In this process, the stator should be operated at an input voltage of 12 to 500 Volts corresponding to the lowest electrical losses. Because of the available mechanisms for current regeneration, not explained in greater detail, the drive mechanism according to the invention can be operated at very low power. It is proposed to convert the linear drive mechanism according to the invention to generator operation shortly before one of its excursion limits is reached. The drive speeds of the valve are reduced to almost "zero" at these reversal points, or very "soft" set speeds between approx. 0.1 and 1 m/s are expected. The electric power generated because of the power-generating speed reduction in the ring windings of the stator is conducted back (by the intermediate circuit) to the mechanisms for current regeneration via the voltage converter, according to the present invention. The power obtained in this manner can be used for the next valve lifting operation. Thus, only an extremely low amount of power, which is clearly lower than for the state of the art until now, needs to be supplied to the entire drive mechanism. Only the losses due to friction and electrical losses which occur need to be compensated.

The conversion mentioned, in the generating operation, can also be used to vary the valve in its lift.

For the exact position determination of the linear drive mechanism according to the invention, and thus the control of the valve lift, the linear drive mechanism is used as a measurement system according to the inductive or eddy measurement principle. For this, the stator is impinged with electric power at a higher frequency than that of the drive power. Depending on the axial position of the rotor, another magnetic/inductive resistance results for this power which can be evaluated by an electronic evaluation mechanism in the assigned path. The control and evaluation are located in the voltage converter. No separate supply line is necessary.

Since this drive mechanism is to be controlled by a microprocessor, additional input quantities to the microprocessor can be provided, such as the crankshaft angle, the rotational speed of the internal combustion engine, the gas pedal position, and the motor moment. The microprocessor can calculate and electrically control the optimal valve function, i.e. its opening duration, its lift travel, and its opening and closing time.

In order to increase a power density of the aforementioned voltage converter using additional electronic structural components, the components mentioned can be liquid-cooled.

Likewise the valve can be manufactured from a light material such as engineering ceramic material. Because of the lower weight in comparison to valves constructed thus far, lower power quantities are necessary to move the valve (based on the reduction of the oscillating masses). At the same time, the combustion space of the internal combustion engine is designed to be more heat-insulating by the head of the valve also being made from ceramic.

A gap located between an outer sleeve of the rotor and the stator should be as small as possible, advantageously in a range from approximately 1/20 to 1/200 of an outer diameter of the rotor. Thus, a very high degree of efficiency is created on the electrical linear drive mechanism.

BRIEF DESCRIPTION OF THE DRAWING

The foregoing summary, as well as the following detailed description of preferred embodiment of the invention, will be better understood when read in conjunction with the appended drawing. For the purpose of illustrating the invention, there is shown in the drawing an embodiment which is presently preferred. It should be understood, however, that the invention is not limited to the precise arrangements and instrumentalities shown.

The only drawing figure shows a drive mechanism according to the invention for moving a valve for a gas exchange of an internal combustion engine in a longitudinal section through a cylinder head region.

DETAILED DESCRIPTION OF THE INVENTION

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the drive mechanism 1 for periodically impinging at least one valve in accordance with the present invention and designated parts thereof. The terminology includes the words above specifically mentioned, derivatives thereof and words of similar import.

The drawing shows a drive mechanism 1 for the periodic movement of at least one valve 2 for gas exchange of an internal combustion engine. The valve 2 is held in a guide 6 of a surrounding part 7 (cylinder head) so that it moves longitudinally. In the drawing, it rests with its head or closing plate 4 on a seat 3. Thus, the valve 2 has reached an upper excursion limit position and a gas exchange is not made possible. In the area of an end 8 of the shaft 5, the valve 2 is provided with a fixed rotor 9 having ring windings 10 on its outer sleeve 11. These ring windings 10 are also considered to be short-circuit windings. The outer sleeve 11 of the rotor 9 (which is preferably made of transformer plate) is constructed having a small gap 22 set at a distance from a ring-shaped stator 12 made of transformer plate which is low in magnetic losses and has internal ring windings 13, made out of copper, for example. This stator 12 extends at least over the axial lifting range of the valve 2 with the rotor 9.

A receptacle for the stator 12 is made via bore 15 extending in the direction of the valve, having a bottom 16 on the valve side. On this bottom 16, a spring mechanism 17 (shown here as a coil spring) is supported. This spring mechanism 17 acts on the other end against the rotor 9. Thus, the valve is held in its closed condition, in the state of the drive mechanism 1 without current, by the spring mechanism 17. In this process, the spring mechanism 17 is designed to have a very weak spring force (see description introduction). A limiting piece 20, facing away from the valve 2 and having the bottom 19, is preferably provided in the bore 15. Another spring mechanism 18 may be supported on the bottom 19 which simultaneously acts on the rotor 9 and is set with its force opposite the force of the first spring mechanism 17. Both spring mechanisms 17, 18 are designed to be approximately equal in their spring forces so that the entire drive mechanism can also operate in resonance.

The stator 12 is provided with electrical supply lines 20*a*. These supply lines 20*a* are connected to a voltage converter 13*a* with a microprocessor 14. The voltage converter 13*a* is provided with a mechanism 21 (not shown in greater detail) for current regeneration and control, as well as with an evaluation unit for measurement of the lift. Here, the reference number 23 indicates the input quantities supplied to the microprocessor, such as the angle position of the crankshaft, the rotational speed of the internal combustion engine, the motor moment, the gas pedal position, and other input quantities. The reference number 24 stands for the on-board electrical system, for example at an input voltage of 14 V, where the output voltage should be 12 to 500 V.

If the ring windings 13 of the stator 12 are now supplied with an electrical power in the form of a linear oscillating field, the rotor 9 is moved due to the magnetic field and opposite the force of the spring mechanism 17 at a very high speed with the valve 2 in the direction to the lower excursion limit. As mentioned, lift travels of 10 mm can be obtained at a lift frequency of 120 Hz. Shortly before reaching the lower excursion limit, the drive mechanism 1 is switched over to generator operation, i.e. electrical power is supplied to the converter 13*a* and stored in an intermediate d.c. circuit. This power then is available for the next acceleration operation of the valve 2. By this switch-over, the valve 2 with rotor 9 is reduced in speed so that a contact, which is extremely low in noise, at speeds in the range from 0.1 to 1 m/s of the valve 2 at its lower excursion limit (or selectively upper excursion limit, is expected. The system is supplied with a power from the supply line 24 which replaces the frictional losses and electrical losses.

The construction of the rotor 9 and the stator 11 can be varied in special embodiments (by varying wall thickness, optional ring windings 10, optional reluctance slots, among others), such that the drive mechanism can operate according to the principle of a synchronized motor, a reluctance motor or an asynchronous motor. At the same time, by use of the drive mechanism 1 according to the invention, a non-graduated variation of the lift travel of the rotor 9 with valve 2 is created in order to make smaller gas exchange cross sections than the maximum possible gas exchange cross section.

The gap indicated by 22 should be constructed as small as possible in order to obtain a very high degree of efficiency on the electric drive mechanism 1. The expert will dimension the gap 22 between 0.5 and 5% of an outer diameter of the rotor 9.

Accordingly, a simply constructed electric drive mechanism 1 (linear drive mechanism) for a valve is provided. The valve 2 functions, for example, to create a gas exchange of an internal combustion engine. Moreover, reference is made to the embodiments in the descriptive introduction.

It will be appreciated by those skilled in the art that changes can be made to the embodiments described above without departing from the broad inventive concept. It is understood, therefore, that this invention is not limited to the particular embodiments disclosed, but it is intended to cover modifications within the spirit and scope of the present invention.

I claim:

1. Drive mechanism (1) for the periodic movement of at least one valve (2) for a gas or liquid exchange in at least one of opening and closing directions of the valve comprising:

a valve (2) including a closing plate (4) which rests on a seat (3) in a closed position and a shaft (5), attached to the plate (4), which is located in a guide (6) of a surrounding part (7) such that the shaft moves axially;

the shaft (5) having a first end (8) to which a disc-type rotor (9) is attached which has at least one electrically conducting ring winding (10) extending in a circumferential direction;

the rotor (9) including an outer sleeve (11) which is surrounded at least in a portion of a lift range, by a ring-shaped stator (12) spaced from the rotor and having at least one electrically conducting, coil-type ring winding (13); and a voltage converter (13*a*) with a microprocessor (14) which provides electrical power to the ring winding (13) of the stator (12) to control movement of the valve (2), the stator (12) functioning according to a principle of one of a synchronized motor, a reluctance motor and an asynchronous motor.

2. The drive mechanism according to claim 1, wherein the drive mechanism (1) is constructed for movement of a valve (2) for gas exchange in an internal combustion engine.

3. The drive mechanism according to claim 1 wherein the stator (12) is arranged in a bore (15) in the surrounding part (7), which is constructed as a cylinder head of an internal combustion engine, and extends in a direction to the plate (4), the bore (15) including a bottom (16), and a first spring mechanism (17) is located in the bore (15) between the bottom and the rotor (9).

4. The drive mechanism according to claim 3, wherein the first spring mechanisum (17) comprises a first compression spring having a compression force, the force of the first compression spring (17) is constructed to be of small dimensions such that the force is smaller than the mass force of the valve (2) when the internal combustion engine is running at an idle, and is larger than the compression force created from a dead weight of the valve (2) with the rotor (9).

5. The drive mechanism according to claim 3, wherein the rotor (9) is acted upon by an additional spring mechanism (18) whose force is approximately equal to and opposes the force of the first compression spring (17).

6. The drive mechanism according to claim 5, wherein the bore hole (15) in the surrounding part (7) is closed by a base (19) of a limiting part (20) in a direction away from the bottom (16) of the bore (15), the additional spring (18) is supported against the base (19).

7. The drive mechanism according to claim 1, wherein the converter (13*a*) for the stator (12) is provided with a mechanism (21) for at least one of current regeneration and power storage in an intermediate d.c. circuit.

8. The drive mechanism according to claim 1, wherein an electrical supply is connected to the voltage converter, and the drive mechanism (1) is operated at a voltage between 12 and 500 V, from the electrical supply (20*a*) to the converter (13*a*).

9. The drive mechanism according to claim 1, wherein a gap (22) is located between the outer sleeve (11) of the rotor (9) and the stator (12) and corresponds to approximately 1/20 to 1/200 of an outer diameter of the rotor (9).

10. A process for operating the drive mechanism (1) according to claim 1, comprising:

supplying the stator (12) with an electrical voltage in a firs step; and in a subsequent step, immediately before reaching an excursion limit of the valve (2), switching the drive mechanism (1) to a generating operation, generating electrical energy, and selectively storing the generated electrical energy in an intermediate d.c. circuit of the voltage converter (13*a*).

11. The drive mechanism according to claim 1, wherein the valve (2) is manufactured from an engineering ceramic material.

12. The drive mechanism according to claim 1, wherein the converter (13*a*) is provided with a control and evaluation unit for measuring a position/lift travel of the drive mechanism (1).

13. The drive mechanism according to claim 1, wherein there are at least two valves (2) which are operated at the same time, the voltage connection 13(*a*) is used to control the at least two valves (2).

* * * * *